US006755306B2

(12) United States Patent
Maus

(10) Patent No.: US 6,755,306 B2
(45) Date of Patent: Jun. 29, 2004

(54) SHIPPING AND DISPLAY CARTON

(75) Inventor: David George Maus, Oakland, NJ (US)

(73) Assignee: Reckitt Benckiser Inc., Wayne, NJ (US)

( * ) Notice: Subject to any disclaimer, the term of this patent is extended or adjusted under 35 U.S.C. 154(b) by 0 days.

(21) Appl. No.: 10/299,201

(22) Filed: Nov. 19, 2002

(65) Prior Publication Data

US 2003/0150747 A1 Aug. 14, 2003

Related U.S. Application Data

(63) Continuation of application No. PCT/GB01/02168, filed on May 18, 2001.

(30) Foreign Application Priority Data

May 19, 2000 (GB) ..... 0012102

(51) Int. Cl.[7] ..... B65D 25/54

(52) U.S. Cl. ..... 206/774; 229/120.011; 229/164

(58) Field of Search ..... 206/736, 738, 206/745, 746, 774; 229/164, 200, 207, 235, 240, 241, 242, 120.011

(56) References Cited

U.S. PATENT DOCUMENTS

| | | | | |
|---|---|---|---|---|
| 3,542,192 A | * | 11/1970 | Steck | 229/235 |
| 3,917,158 A | * | 11/1975 | Dorofachuk et al. | 229/241 |
| 4,008,849 A | | 2/1977 | Baber | |
| 4,113,100 A | | 9/1978 | Soja et al. | |
| 4,553,666 A | * | 11/1985 | Gullikson | 229/235 |
| 4,815,609 A | * | 3/1989 | Kiedaisch | 229/235 |
| 4,905,837 A | | 3/1990 | Schuster et al. | |
| 5,351,881 A | | 10/1994 | DeMay | |
| 5,582,345 A | * | 12/1996 | Lankhuijzen | 229/242 |
| 5,651,497 A | * | 7/1997 | Ventura et al. | 229/235 |
| 5,881,884 A | | 3/1999 | Podosek | |

FOREIGN PATENT DOCUMENTS

| | | |
|---|---|---|
| EP | 1 072 523 A1 | 1/2001 |
| FR | 2 581 971 A | 11/1986 |
| FR | 2 766 793 A1 | 2/1999 |
| JP | 09020332 A | 1/1997 |
| JP | 09207932 A | 8/1997 |
| JP | 09254959 A | 9/1997 |

* cited by examiner

*Primary Examiner*—Luan K. Bui
(74) *Attorney, Agent, or Firm*—Akin Gump Strauss Hauer & Feld, L.L.P.

(57) ABSTRACT

A blank for forming a carton includes a top flap, top panel, front panel, bottom panel, and rear panel which are connectively hinged together in the named order such that when folded, the top flap is fastened to the rear panel. Right and left side flaps are also connectively hinged to the aforementioned panels. A first tear strip is placed within the front panel and the right and left side flaps attached thereto and a second tear strip is placed at the juncture of the top flap and top panel. After tearing and removing the tear strips, a display carton is formed to hold and display a plurality of articles.

6 Claims, 4 Drawing Sheets

SHIPPING AND DISPLAY CARTON

CROSS-REFERENCE TO RELATED APPLICATIONS

This application is a continuation of International Application No. PCT/GB01/02168, filed May 18, 2001, which was published in the English language on Nov. 22, 2001 as International Publication No. WO 01/87721 A1 and the disclosure of which is incorporated herein by reference.

BACKGROUND OF THE INVENTION

The present invention relates generally to cartons for use in shipping a plurality of articles and more particularly to cartons for use in shipping a plurality of articles which can be converted to display the plurality of articles contained therewithin.

It is a well known practice to employ cartons to package, store and transport sales articles from the manufacturer to the place of sale, such as a retail store. Conventionally, cartons, also referred to as containers, are formed from a one-piece blank made of corrugated paperboard which is suitably cut, scored and folded to produce a generally rectangularity shaped box. Once the carton reaches the place of sale, the articles held therewithin are unpacked from the carton and are typically placed on display shelves. Cartons can also be used as end aisle or mid-aisle displays where opened cartons can be placed on top of other unopened and/or opened cartons, permitting a customer to see and select the articles which are placed within the cartons.

One drawback of such cartons is that a significant amount of labor is required to remove the articles from the carton and, in turn, place them on the display shelves.

To reduce packaging costs, combined shipping and display packages have been utilized. The cartons used to form the packages have to be strong enough to support and protect the articles during shipment and in addition be capable of presenting the articles on display. This has resulted in the use of relatively complicated carton designs which require somewhat involved set-up procedures, often entailing the reassembly of the shipping carton into a display package having a different appearance. Such combination shipping and display packages are often limited to handling only small numbers of articles.

Accordingly, it is well known in the art for cartons which can be utilized to ship the plurality of sales articles to be convertible into a display device at the place of sale, thereby eliminating the labor required in transferring the articles from the carton to the shelves of the place of sale. Such cartons normally comprise a separable upper section which is torn away from the lower section by a tear strip or perforated tear line formed through panels of the carton to expose the packaged articles for display.

Certain of such cartons are described in U.S. Pat. No. 4,905,837; U.S. Pat. No. 5,351,881; and U.S. Pat. No. 5,881,884. However, these cartons can have intricate tabs and flaps which make the blank for the carton difficult to make. In addition, certain flaps will have been adhered together (for example, by adhesive tape) and the adhesive tape may have to be separated before the carton can be separated into separate sections.

Thus, the need exists for a carton which can be separated to form a display for articles which does not require intricate tabs and flaps nor requires the separation of adhesive tape.

BRIEF SUMMARY OF THE INVENTION

It is an object of the present invention to provide a new and useful carton which can be used for shipping a plurality of articles.

It is another object of the present invention to provide a carton which can be easily converted to enable it to be used for displaying the plurality of articles held therewithin.

It is yet another object of the present invention to provide a carton which is formed from a single-piece blank.

It is still another object of the present invention to provide a carton which is durable and strong.

It is yet still another object of the present invention to provide a carton which is simple and inexpensive to manufacture.

In accordance with one aspect of the invention, a carton for use in the shipping and display of a plurality of articles is provided. The carton is formed from a single-piece corrugated paperboard blank and comprises a top flap, a top panel foldably connected to the top flap, a front panel foldably connected to the top panel, a bottom panel foldably connected to the front panel, and a rear panel foldably connected to the bottom panel to form a box-shaped shipping carton having an open right side and an open left side. The carton further comprises a right flap that is foldably connected to each of the top, front, bottom and rear panels, with each of the right flaps having an edge not foldably connected to its associated panel and being sized and shaped so as to at least partially close the open right side when folded, and a left flap foldably connected to each of the top, front, bottom and rear panels, with each of the left flaps having an edge not foldably connected to its associated panel and being sized and shaped so as to at least partially close the open left side when folded. A first continuous tear line is formed in a first panel of the top, front, bottom and rear panels and in a first of the right and left flaps connected to the first panel. The first tear line starts at the edge of the first left flap and terminates at the edge of the first right flap. A second continuous tear line is formed in a second panel of the top, front, bottom and rear panels and in a second of the right and left flaps connected to the second panel. The first and second panels are preferably different panels. The second continuous tear line starts at the edge of the second left flap and terminates at the edge of the second right flap. The carton is severable along the first and second tear lines to enable a portion of the carton to be removed to convert the carton into a display carton for a plurality of articles.

In accordance with a further aspect of the invention, a carton for use in the shipping and display of a plurality of articles is provided. The carton is formed from a single-piece corrugated paperboard blank and comprises a top flap, a top panel foldably connected to the top flap, a front panel foldably connected to the top panel, a bottom panel foldably connected to the front panel, and a rear panel foldably connected to the bottom panel to form a box-shaped shipping carton having an open right side and an open left side. The carton further comprises a right flap that is foldably connected to each of the top, front, bottom and rear panels, with each of the right flaps having an edge not foldably connected to its associated panel and being sized and shaped so as to at least partially close the open right side when folded, and a left flap foldably connected to each of the top, front, bottom and rear panels, with each of the left flaps having an edge not foldably connected to its associated panel and being sized and shaped so as to at least partially close the open left side when folded. A first continuous tear line is formed in the front panel and in the right and left flaps connected to the front panel. The first tear line starts at the edge of the left flap and terminates at the edge of the right flap. A second continuous tear line is formed at a connection between the top flap and the top panel. The carton is severable along the first and second tear lines to enable a portion of the carton to be removed to convert the carton into a display carton for a plurality of articles.

In accordance with an even further aspect of the invention, a blank for forming a carton is provided. The blank is formed from a single-piece of corrugated paperboard. The blank is cut and scored to comprise a top flap, a top panel foldably connected to the top flap, a front panel foldably connected to the top panel, a bottom panel foldably connected to the front panel, and a rear panel foldably connected to the bottom panel. The blank further comprises a right flap foldably connected to each of the top, front, bottom and rear panels, with each of the right flaps having an edge not foldably connected to its associated panel, and a left flap foldably connected to each of the top, front, bottom and rear panels, with each of the left flaps having an edge not foldably connected to its associated panel. A first continuous tear line is formed in a first panel of the top, front, bottom and rear panels and in a first of the right and left flaps connected to the first panel. The first tear line starts at the edge of the first left flap and terminates at the edge of the first right flap. A second continuous tear line is formed in a second panel of the top, front, bottom and rear panels and in a second of the right and left flaps connected to the second panel. The first and second panels are preferably different panels. The second continuous tear line starts at the edge of the second left flap and terminates at the edge of the second right flap.

In accordance with yet an even further aspect of the invention, a blank for forming a carton is provided. The blank is formed from a single-piece of corrugated paperboard. The blank is cut and scored to comprise a top flap, a top panel foldably connected to the top flap, a front panel foldably connected to the top panel, a bottom panel foldably connected to the front panel, and a rear panel foldably connected to the bottom panel. The blank further comprises a right flap foldably connected to each of the top, front, bottom and rear panels, with each of the right flaps having an edge not foldably connected to its associated panel, and a left flap foldably connected to each of the top, front, bottom and rear panels, with each of the left flaps having an edge not foldably connected to its associated panel. A first continuous tear line is formed in the front panel and in the right and left flaps connected to the front panel. The first tear line starts at the edge of the left front flap and terminates at the edge of the right front flap. A second continuous tear line is formed at a connection between the top flap and the top panel.

Additional objects and features of the present invention, as well as its advantages, will be set forth in part in the detailed description which follows. The embodiments will be described in sufficient detail to enable those skilled in the art to practice the invention, and it is to be understood that other embodiments may be utilized and that structural changes may be made without departing from the scope of the invention.

The accompanying drawings, which are hereby incorporated into and constitutes a part of this specification, illustrate an embodiment of the invention and, together with the description, serve to explain the principles of the invention. In the drawings, like reference numerals represent like parts.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
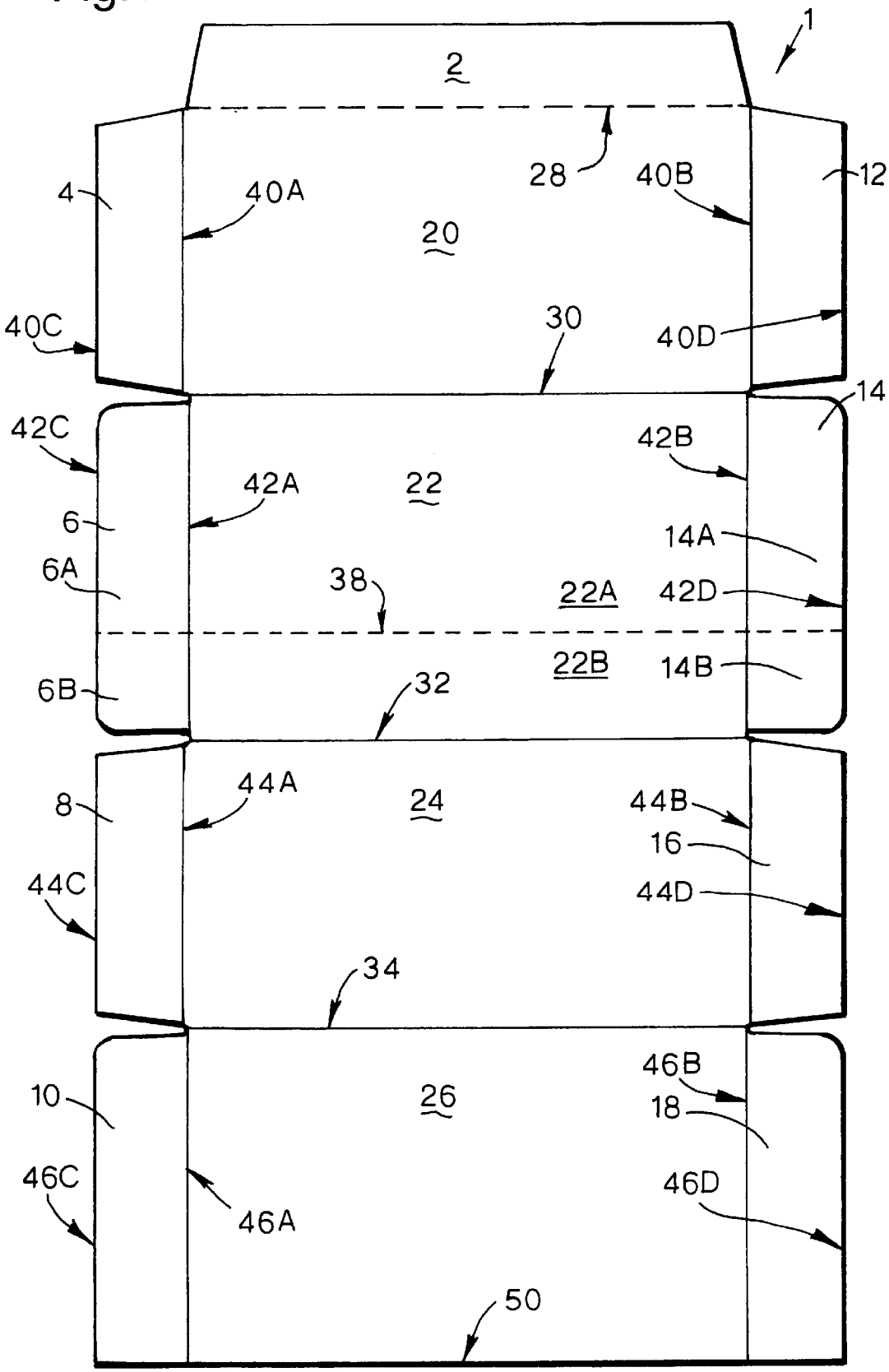
FIG. 1 is a plan view of a blank for forming the separable carton of the invention, the side of the blank which forms the exterior surface of the carton being shown.

Referring to the drawings, and to FIG. 1 in particular, a carton blank 1 is comprised of a single-piece of corrugated paperboard. Carton blank 1 comprises top flap 2, top panel 20, front panel 22, bottom panel 24, and rear panel 26. Top flap 2 is connected to top panel 20 by a tear strip 28. Those skilled in the art will appreciate that tear strip 28 can be tear tape or can be a scoreline which is perforated so that at an appropriate time after the carton is formed, top flap 2 can be disengaged from top panel 20. Right side flap 12 has free edge 40D and is hinged connectively to top panel 20 by a scoreline 40B. Left side flap 4 has free edge 40C is hinged connectively to top panel 20 by a scoreline 40A.

Top panel 20 is hinged connectively to front panel 22 by a scoreline 30. Right side flap 14 has free edge 42D and is hinged connectively to front panel 22 by a scoreline 42B. Left side flap 6 has free edge 42C and is hinged connectively to front panel 22 by a scoreline 42A. Disposed within right side flap 14, front panel 22, and left side flap 6 is a continuous tear strip 38, starting at edge 42C and ending at edge 42D. Tear strip 38 bisects right side flap 14 into sections 14A and 14B, bisects front panel 22 into section 22A and 22B, and bisects left side flap 6 into sections 6A and 6B. While tear strip 38 can be generally placed anywhere within right side flap 14, front panel 22, and left side flap 6, preferably, tear strip 38 is placed parallel to scoreline 32, which connects front panel 22 to bottom panel 24. Also, it is further preferred that tear strip 38 is placed within right side flap 14, front panel 22, and left side flap 6 such that the distance of tear strip 38 from scoreline 32 is less than or equal to the width of either right side flap 14 or left side flap 6, while in parallel orientation with scoreline 32.

Bottom panel 24 is hinged connectively to front panel 22 by a scoreline 32. Right side flap 16 has free edge 44D and is hinged connectively to bottom panel 24 by a scoreline 44B. Left side flap 8 has free edge 44C and is hinged connectively to bottom panel 24 by a scoreline 44A.

Rear panel 26 is hinged connectively to bottom panel 24 by a scoreline 34. Right side flap 18 has free edge 46D and is hinged connectively to rear panel 26 by a scoreline 46B. Left side flap 10 has free edge 46C and is hinged connectively to rear panel 26 by a scoreline 46A. Rear panel 26 has edge 50. When carton blank 1 is folded along scorelines 30, 32, and 34, edge 50 engages tear strip 28 such that top flap 2 is folded onto rear panel 26. Top flap 2 can be attached to rear panel 26 using a variety of methods, for example, adhesive glue or adhesive tape.

The carton is formed from blank 1 by first folding along scorelines 30, 32, and 34 and then engaging edge 50 into tear strip 28. Top flap 2 is then joined to rear panel 26 using a fastening material, for example, an adhesive material, for example, glue, paste, tape, and the like or a staple or a hook and loop set of material (commonly known as Velcro). Right side flaps 12, 14, 16, and 18 are then folded along their respective scorelines 40B, 42B, 44B, and 46B towards the interior of the carton. Likewise, left side flaps 4, 6, 8, and 12 are then folded along their respective scorelines 40A, 42A, 44A, and 46A towards the interior of the carton. In so doing is formed carton 60 shown in FIG. 2.

Figure 2:
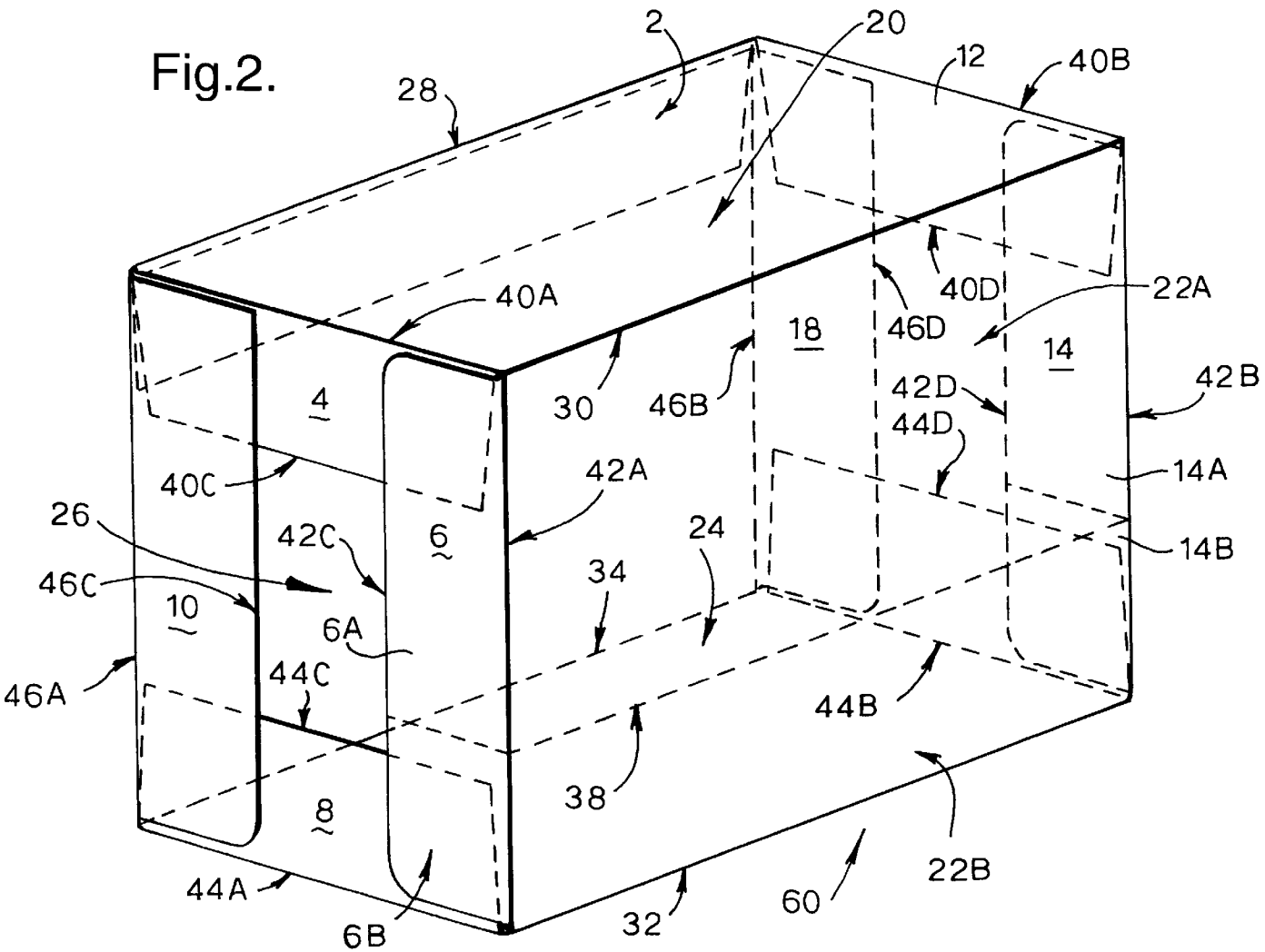
FIG. 2 is front perspective view of a carton formed from the blank of FIG. 1.

In FIG. 2, it is seen that carton blank 1 has now been folded as mentioned above to form carton 60. As can be seen in FIG. 2, left side flap 4 is folded along scoreline 40A to cover a portion of left side flaps 6 and 10. Additionally, left side flap 8 is folded along scoreline 44A to cover a portion of left side flaps 6 and 10. While there is shown an open space when left side flaps 4, 6, 8, and 10 are folded along their respective scorelines 40A, 42A, 44A, and 46A, as mentioned above, left side flaps 4, 6, 8, and 10 can be sized to as to completely close the left side of carton 60.

Likewise, right side flap 12 is folded along scoreline 40B to cover a portion of left side flaps 6 and 10. Additionally, left side flap 8 is folded along scoreline 44B to cover a portion of left side flaps 6 and 10. While there is shown an open space when left side flaps 4, 6, 8, and 10 are folded along their respective scorelines 40B, 42B, 44B, and 46B, as mentioned above, left side flaps 4, 6, 8, and 10 can be sized to as to completely close the left side of carton 60.

To complete assembly of carton 60, a fastening material, is applied to a part of or all of the portion of left side flap 4 which covers a portion of left side flap 6 as mentioned above. Likewise, the fastening material is applied to a part of or all of the portion of left side flap 8 which covers a portion of left side flap 6 and left side flap 10. It is noted that no fastening material is applied to any portion of left side flap 4 which covers left side flap 10. This feature will be explained below.

Likewise, the fastening material is applied to a part of or the entire portion of right side flap 12 which covers a portion of right side flap 14. The fastening material is also applied to a part of or all of the portion of right side flap 16 which covers a portion of right side flap 14 and right side flap 18. It is noted that no fastening material is applied to any portion of right side flap 12 which covers right side flap 18.

Figure 3:
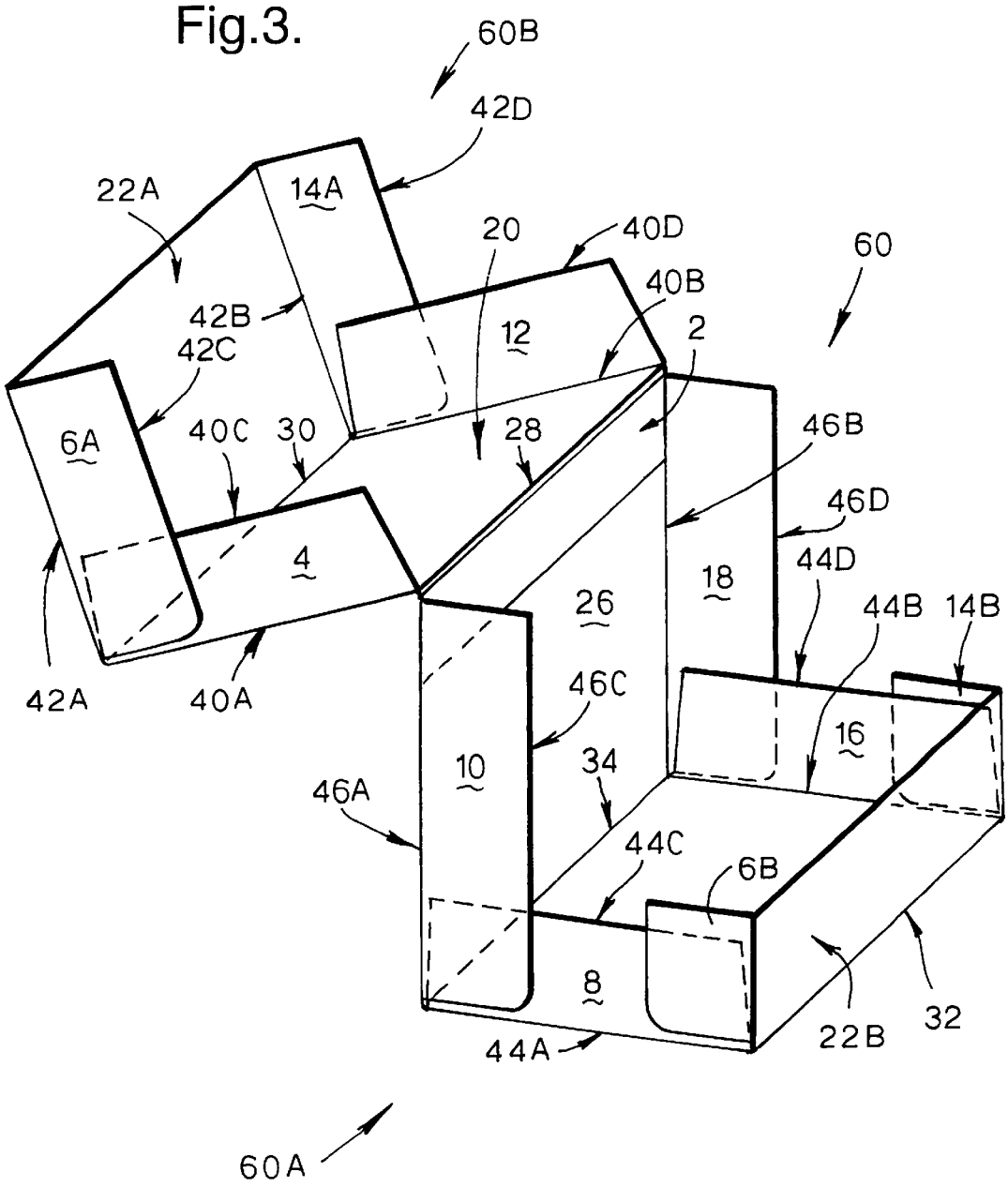
FIG. 3 is a front perspective view of the carton of FIG. 2 where one tear strip has been removed.

FIG. 3 shows carton 60 where tear strip 38 has been pulled and removed to start to form a portion of carton 60 which will be suitable for displaying a plurality of articles (carton display 60A) and a portion of carton 60 which can be discarded (carton portion 60B). As can be seen from FIG. 3, carton display 60A is comprised of portion of front panel 22B, bottom panel 24, rear panel 26, portion of left side flap 6B, left side flap 8, left side flap 10, portion of right side flap 14B, right side flap 16, and right side flap 18 as well as top flap 2.

Carton portion 60B is comprised of portion of front panel 22A, top panel 20, left side flap 4, portion of left side flap 6A, right side flap 12, and portion of right side flap 14A.

By not applying any fastening material to either of any portion of left side flap 4 which covers left side flap 10 or any portion of right side flap 12 which covers right side flap 18, a pivot or hinge is provided where the pivot point or hinge point is formed by tear strip 28.

Figure 4:
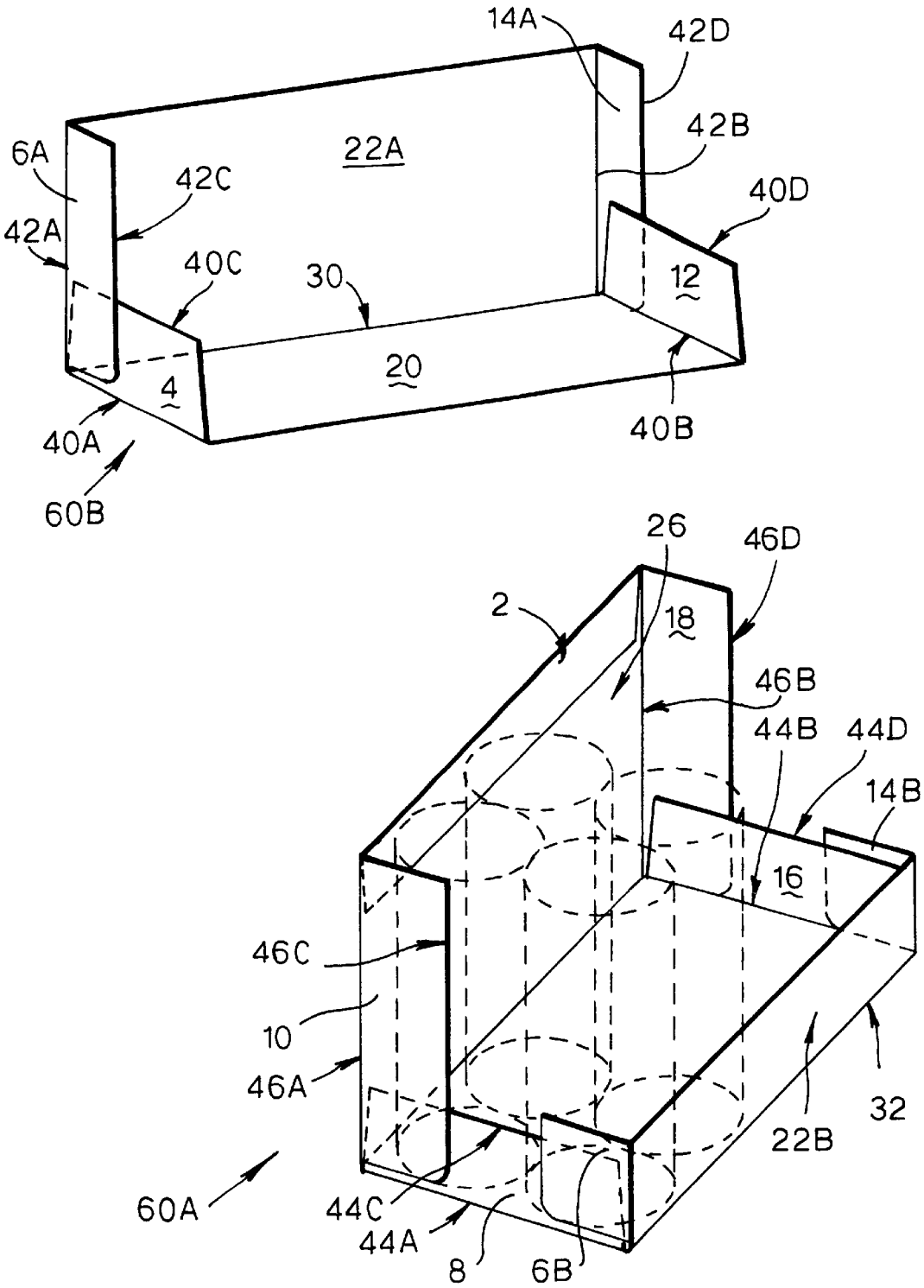
FIG. 4 is a front perspective view of the carton of FIG. 3 where a second tear strip has been removed, showing severance of a portion of the carton to form a carton display suitable for holding a plurality of articles, for example, canisters therein, the canisters being shown in phantom.

FIG. 4 shows carton portion 60B being totally separated from carton display 60A. This is achieved by tearing and removing tear strip 28. By tearing and removing tear strip 28, carton display 60A can now be utilized to contain and display a plurality of articles. Those skilled in the art will appreciate that the size of carton 60 and the resulting size of carton display 60A can be designed to package and display articles of varying height, width and length. In so doing, carton display 60A can be placed on shelving commonly found in supermarket, convenience stores, home centers, drug stores, and other retail and wholesale outlets. Carton display 60A can also be placed on secondary supports (for example, tables, stools, and the like) for end of aisle and midaisle placement within the aforementioned outlets.

The tear strip used in the present invention is placed on the corrugated paperboard such that the tear strip is perpendicular to the corrugation. While any type of tear strip can be used, it is preferred to use as a tear strip 38 found within front panel 22, left side flap 6 and right side flap 14 a tear tape known as Open Sesame Tape available from Weyerhaeuser. This tape is a two-layer tape with one layer on the face of the paperboard and a second layer embedded within the corrugation. While the same tear tape can be used for tear strip 28, it is preferable to provide a perforation as tear strip 28.

Additionally, while tear strip 38 can be a continuous strip from edge 42C of left side flap 6 across front panel 22, and right side flap 14 to edge 40D, preferably at least one notch is placed within front panel 22 so that a finger can be inserted so as to grab onto a tab formed by the notch so that tear strip can be pulled and removed, pulling one part of the tear strip from the notch towards left flap edge 42C and pulling the other part of the tear strip from the notch towards right flap edge 40D.

While the sizing of the panels and flaps can be determined so as to accommodate the shipping and displaying of articles, the placement of tear strip 38 on front panel 22 is dependent upon the width of left side flap 6 (it being appreciated that right side flap 14 will be the same width as left side flap 6). Tear strip 38 should be placed on front panel 22 up from scoreline 32 such that its placement is no further than the width of left side flap 6 (or right side flap 14).

As discussed above, the first and second tear lines can be placed in the carton blank such that the first tear line is in a different panel from the second tear line. Thus, it can be envisioned that a first tear line could be placed, for example, in panel 20 and its associated flaps 4 and 12 and that a second tear line could be placed, for example, in panel 22 and its associated flaps 6 and 14. It could also be envisioned, for example, that a first tear line could be placed in panel 22 and its associated flaps 6 and 14 and that a second tear line could be placed in panel 26 and its associated flaps 10 and 18. Where either or both first and second tear lines are not at a score line, all the associated flaps in the carton are appropriately fastened to each other.

As mentioned above, a preferred embodiment of the present invention is a carton made from a single piece blank. However, those of ordinary skill in the art will appreciate that cartons can be made from multi-piece (that is, greater than one) blanks, where each blank potentially may contain at least one tear line such that when the carton is assembled, the tear lines can be utilized to form a display carton as envisioned by the present invention.

The invention has been described in detail with particular reference to certain preferred embodiments thereof, but it will be understood that variations and modifications can be effected within the spirit and scope of the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A carton for use in the shipping and display of a plurality of articles, said carton being formed from a single-piece corrugated paperboard blank, said carton comprising:

(a) a top flap, a top panel foldably connected to the top flap, a front panel foldably connected to the top panel, a bottom panel foldably connected to the front panel, and a rear panel foldably connected to the bottom panel to form a box-shaped shipping carton having an open right side and an open left side;

(b) a right flap foldably connected to each of the top, front, bottom and rear panels, each of the right flaps having an edge not foldably connected to its associated panel, said right flaps being sized and shaped so as to at least partially close said open right side when folded;

(c) a left flap foldably connected to each of the top, front, bottom and rear panels, each of the left flaps having an edge not foldably connected to its associated panel, said left flaps being sized and shaped so as to at least partially close said open left side when folded;

(d) a first continuous tear line formed in said front panel and in the right and left flaps connected to said front panel, said first tear line starting at the edge of said left flap and terminating at the edge of said right flap; and (e) a second continuous tear line formed at a connection between said top flap and said top panel;

(f) said carton being severable along said first and second tear lines to enable a portion of said carton to be removed to convert said carton into a display carton for a plurality of articles.

2. The carton of claim 1 wherein the first continuous tear line is a tear strip.

3. The carton of claim 1 wherein the right flap of said front panel is affixed to the right flap of said top panel and the right flap of said bottom panel, the right flap of said rear panel is affixed to the right flap of said bottom panel, the left flap of said front panel is affixed to the left flap of said top panel and the left flap of said bottom panel, and the left flap of said rear panel is affixed to the left flap of said bottom panel.

4. A blank for forming a carton, said blank being formed from a single-piece of corrugated paperboard, said blank being cut and scored to comprise:

(a) a top flap, a top panel foldably connected to the top flap, a front panel foldably connected to the top panel, a bottom panel foldably connected to the front panel, and a rear panel foldably connected to the bottom panel;

(b) a right flap foldably connected to each of the top, front, bottom and rear panels, each of the right flaps having an edge not foldably connected to its associated panel;

(c) a left flap foldably connected to each of the top, front, bottom and rear panels, each of the left flaps having an edge not foldably connected to its associated panel;

(d) a first continuous tear line formed in said front panel and in the right and left flaps connected to said front panel, said first tear line starting at the edge of said left front flap and terminating at the edge of said right front flap; and (e) a second continuous tear line formed at a connection between said top flap and said top panel.

5. The blank of claim wherein the first continuous tear line is a tear strip.

6. A carton formed from the blank of claim 4.

* * * * *